US009580916B2

(12) United States Patent
Tchakarov et al.

(10) Patent No.: US 9,580,916 B2
(45) Date of Patent: Feb. 28, 2017

(54) METHOD FOR FINISHING A COMPOSITE SURFACE AND A GROUNTING PAN FOR FINISHING A COMPOSITE SURFACE

(71) Applicant: DIAMOND TOOL SUPPLY, INC., Monroe, MI (US)

(72) Inventors: Tchavdar V. Tchakarov, Monroe, MI (US); Eric Gallup, Rochester Hills, MI (US); Robert James Michielutti, St. Clair Shores, MI (US)

(73) Assignee: Diamond Tool Supply, Inc., Monroe, MI (US)

( * ) Notice: Subject to any disclaimer, the term of this patent is extended or adjusted under 35 U.S.C. 154(b) by 212 days.

(21) Appl. No.: 14/490,012

(22) Filed: Sep. 18, 2014

(65) Prior Publication Data

US 2016/0083967 A1 Mar. 24, 2016

(51) Int. Cl.

| | |
|---|---|
| ***E04F 21/16*** | (2006.01) |
| ***E04F 21/06*** | (2006.01) |
| ***E04F 15/12*** | (2006.01) |
| ***E04F 21/24*** | (2006.01) |

(52) U.S. Cl.
CPC ..... *E04F 15/126* (2013.01); *E04F 21/245* (2013.01)

(58) Field of Classification Search
CPC ..... E04F 21/06; E04F 21/16; E04F 21/245; E04G 21/201; E04G 21/20
USPC ..... 451/350, 353, 359, 360; 15/180
See application file for complete search history.

(56) References Cited

U.S. PATENT DOCUMENTS

| | | | | |
|---|---|---|---|---|
| 2,556,983 | A | 6/1951 | Root | |
| 2,662,454 | A * | 12/1953 | Whiteman | E04F 21/248 15/235.4 |
| 2,963,059 | A | 12/1960 | Grub | |
| 4,781,556 | A | 11/1988 | Paul | |
| 4,939,872 | A * | 7/1990 | Revelin | E04F 21/24 15/98 |
| 5,372,452 | A | 12/1994 | Hodgson | |
| 5,449,406 | A | 9/1995 | Presti, Jr. | |
| 5,632,570 | A | 5/1997 | Balling | |
| 5,882,249 | A * | 3/1999 | Ferland | E04F 21/248 451/359 |
| 7,004,676 | B2 | 2/2006 | Williams | |
| 7,144,194 | B2 | 12/2006 | Kipp, Jr. | |
| 7,172,365 | B2 | 2/2007 | Lutz et al. | |
| 7,674,069 | B2 | 3/2010 | Stenzel | |
| 9,050,625 | B1 | 6/2015 | Bonachea Ruiz | |
| 2006/0073776 | A1 * | 4/2006 | Gallup | B24B 7/186 451/353 |
| 2010/0240282 | A1 * | 9/2010 | Young | B24B 1/00 451/28 |

(Continued)

FOREIGN PATENT DOCUMENTS

WO WO 2008065210 A1 * 6/2008 ..... E04F 21/16

*Primary Examiner* — Cachet Sellman
(74) *Attorney, Agent, or Firm* — Harness, Dickey & Pierce, P.L.C.

(57) ABSTRACT

Methods and apparatus are provided for finishing a composite floor. The apparatus includes a grouting pan configured to be affixed to the rotating head of a finishing machine. The grouting pan has a planar bottom surface and curved sidewall. Grouting pans are rotated over a prepped surface such that the curved sidewalls trowel the mortar onto the rough composite surface and the bottom surface which is in contact with the prepped floor forces the mortar into the surface voids.

35 Claims, 4 Drawing Sheets

(56) References Cited

U.S. PATENT DOCUMENTS

2011/0300784 A1* 12/2011 Tchakarov ..... B24D 7/066
451/259

* cited by examiner

METHOD FOR FINISHING A COMPOSITE SURFACE AND A GROUNTING PAN FOR FINISHING A COMPOSITE SURFACE

TECHNICAL FIELD

The present disclosure relates generally to finishing of composite surfaces, and more particularly relates to a method for filing voids and/or pin holes in the composite surface and grouting pans for use in the method

BACKGROUND

This section provides background information related to the present disclosure which is not necessarily prior art.

Composite surfaces such as epoxy, terrazzo, or cementitious floors generally include a decorative aggregate most commonly marble chips or any suitable aggregate supported in a matrix material. First, a solid, level foundation typical of concrete is established. Next, a subflooring layer is formed on top of the foundation. Historically, this layer is a sandy concrete layer. Metal divider strips may be partially embedded in the concrete before it cures to provide panels in the surface. Finally, a top layer including the matrix material with the decorative aggregate is placed into each of the panels. Historically, the matrix material was a cementitious material but now may be a polymer-based matrix such as epoxy-based. The matrix material may be color-pigmented. The decorative aggregate, while typically marble chips, may be any suitable aggregate e.g., glass, porcelain, concrete, metal, mother of pearl, abalone. While the mixture is still wet, additional aggregate may be broadcast into various panels. Finally, the entire surface is rolled with a weighted roller.

As initially installed, these composite surfaces are porous or semi-porous in nature. Moreover, as the composite surface dries in the case of a cementitious matrix or cures in the case of polymer-based matrix, gases are released from the matrix causing surface imperfections, pin-holes and subsurface voids in the top layer. To address this concern, the top layer is rough cut using very course to course (24-grit to 80-grit) grinding stones or diamond plates. Rough cutting the top layer evens out the surface imperfections but may leave slight depressions. Rough cutting does little to remedy the pin holes and may open up subsurface voids to the surface. If left untreated, these flaws can collect excess wax, dirt and other debris which affects the look and surface quality of the composite surface.

Accordingly, it is necessary to grout the composite surface in an effort to fill the remaining surface imperfections. The rough cut layer is grouted by hand trowelling a mortar onto the composite surface. The mortar is repeatedly wiped back and forth over the surface with a hand trowel. As the trowel approaches a surface imperfection, the mortar covers the indentations and partially fills the subsurface voids. However, as the trowel moves past the surface imperfection, the trowel can pull mortar out of the subsurface void, thus leaving surface imperfections. Even subsurface voids that have been covered with mortar may become exposed as the mortar dries or cures.

Accordingly, it is desirable to develop a method of grouting a rough cut floor which completely fills the surface imperfections. In addition, it is desirable to develop a tool useful in the grouting process and which is configured for use on the finishing machines typically used in conventional grinding and polishing of composite surface. Furthermore, other desirable features and characteristics of the present invention will become apparent from the subsequent detailed description of the invention and the appended claims, taken in conjunction with the accompanying drawings and this background of the invention.

SUMMARY

In one embodiment, an apparatus in the form of a grouting pan is provided for grouting a composite surface. The grouting pan includes a substantially planar bottom surface and a curved sidewall surrounding the bottom surface. The curved side wall has an angled portion and a rounded edge portion formed between the bottom surface and the angled portion such that an obtuse included angle is formed therebetween. A top surface is configured to affix the grouting pan to a rotating head of a finishing machine.

In another embodiment, an apparatus in the form of a grouting pan assembly is provided for grouting a composite surface. The grouting pan assembly includes a carrier having a first face configured to affix the grouting pan assembly to a rotating head of a finishing machine and a second face opposite the first face with a plurality of grouting pans extending therefrom. Each grouting pan includes a substantially planar bottom surface and a curved sidewall surrounding the bottom surface. The curved side wall has an angled portion and a rounded edge portion formed between the bottom surface and the angled portion such that an obtuse included angle is formed therebetween. A top surface is configured to affix the grouting pan to a rotating head of a finishing machine.

In a further embodiment a method is provided for finishing a composite surface. The method includes spreading a mortar over a rough composite surface having surface voids to form a prepped surface. A grouting pan having a curved sidewall extending from a generally flat bottom surface in contact with the prepped floor is rotated over the prepped surface. By way of the rotary movement, the grouting pans are moved in different directions relative to the composite surface so that they are pushed across the surface imperfection composite surface. In doing so, the grouting pans force trapped air out of and mortar into of the pin holes and surface voids. In particular, the sidewall pushes the mortar into the surface imperfections, while the rounded edge and the planar bottom surface compress the mortar in and force air out. This action also thoroughly mixes any filler with the mortar during grouting. The cured surface is finished to form a finished surface.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. There is no intention to be limited by any principle presented in the preceding background or the following detailed description.

Figure 1:
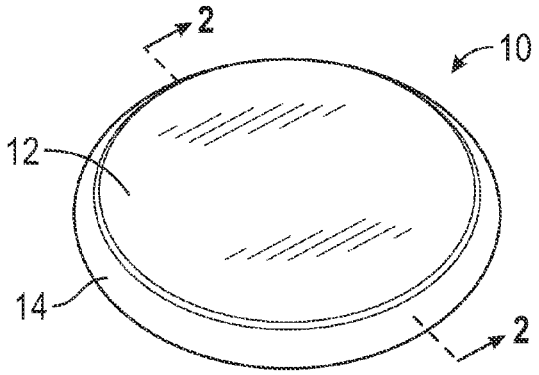
FIG. 1 is a perspective view the grouting pan.
Figure 2:
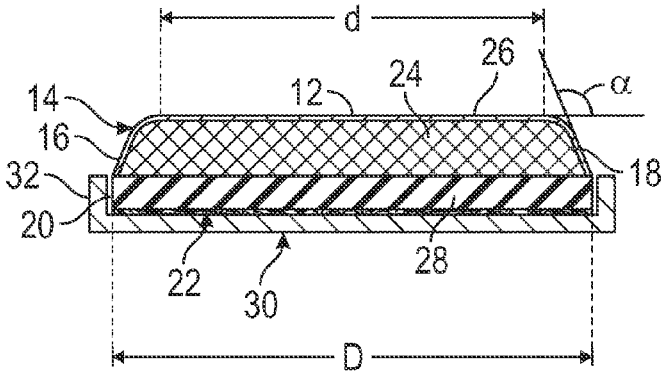
FIG. 2 is a cross-sectional view of the grouting pan shown in FIG. 1.
Figure 3:
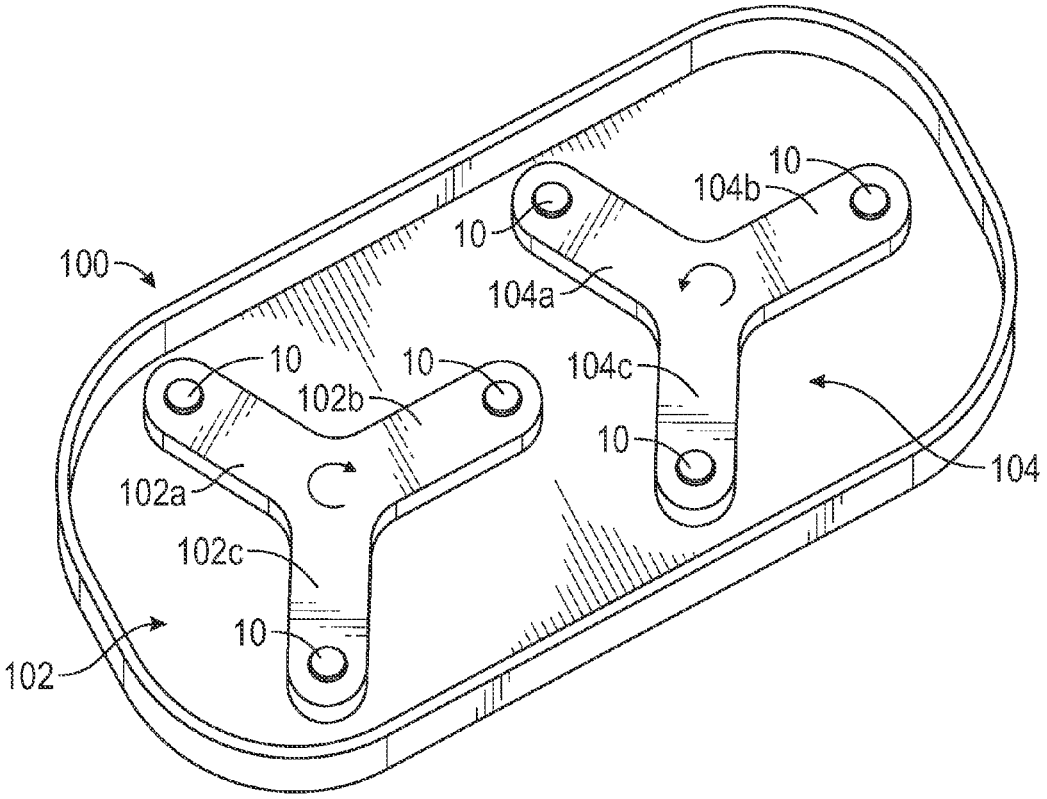
FIG. 3 is a top view showing several grouting pans affixed to a counter-rotating head of a finishing machine.

With reference now to FIGS. 1 and 2, a grouting pan 10 for finishing a composite surface is disclosed. The grouting pan 10 has a substantially planar bottom surface 12, and a curved sidewall 14 surrounding the bottom surface 12. The curved sidewall 14 is defined by an angled portion 16 and a rounded edge portion 18. The curved sidewall 14 may further include a vertical portion 20 extending from the angled portion 16 to a top surface 22. The surface 22 formed on the grouting pan 10 is configured to affix the grouting pan 10 to a rotating head 100 of a finishing machine (not shown) as best seen in FIG. 3. For example, the top surface 22 may be configured to hook or loop material that secures with a corresponding loop or hook material on the rotating head 100.

With specific reference to FIG. 2, the grouting pan 10 includes an inner body 24 supporting a thin-walled outer shell 26. In a preferred embodiment, the thin-walled shell 26 is a metal shell, most preferably stainless steel. The grouting pan 10 may optionally include an intermediate layer 28 disposed between the inner body 24 and the top surface 22. An outer edge of the intermediate layer 28 may define the vertical portion 20 of the curved sidewall 14. The intermediate layer 28 is preferably a compliant material such as rubber or a similar polymeric material and resiliently supports the inner body 24 and the shell 26 from the top surface 22. Optionally, the grouting pan 10 may include a retainer 30 having a rim 32 extending from the top surface 22 towards the bottom surface 12 and surrounding a portion of the sidewall 14.

As presently preferred, the geometry of the grouting pan 10 is configured to efficiently spread mortar over the rough cut layer. In one embodiment, the grouting pan 10 is generally frusto-conical in shape having a top surface 22 with a diameter (D) of about 80 mm and a bottom surface 12 with a diameter (d) of about 64 mm. The height of the sidewall 14 (measured perpendicular to the bottom surface) is about 10 mm. The thickness of the intermediate layer 28 is about 6 mm. The included angle ($\alpha$) is in the range of 100°-135°, and preferably in the range of 110°-120°. The rounded edge has a radius (R) of at least 4 mm and preferably greater than or equal to 6 mm.

With particular reference to FIG. 3, the grouting pan 10 shown in FIGS. 1 and 2 is well suited for use on a finishing machine 100 having heads 102, 104. For example, a grouting pan 10 is affixed at the end of each leg 102*a*, 102*b*, 102*c* of rotating head 102 which rotates in a clockwise direction. Additional grouting pans 10 may be affixed to the rotating head 102 at a position radially inward from the grouting pans 10 shown on the legs 102*a-c*. Similarly, a grouting pan 10 is affixed at the end of each leg 104*a*, 104*b*, 104*c* of counter-rotating head 104 which rotates in a counter-clockwise direction. Additional grouting pans 10 may be affixed to the counter-rotating head 104 at a position radially inward from the grouting pans 10 shown on the legs 102*a-c*. During operation of the finishing machine, the heads 102, 104 rotate the grouting pans 10 over the prepped surface for troweling the mortar onto the rough composite surface with the sidewalls 14 and forcing the mortar into the surface voids with the bottom surface 12 to form a grouted surface.

Figure 4:
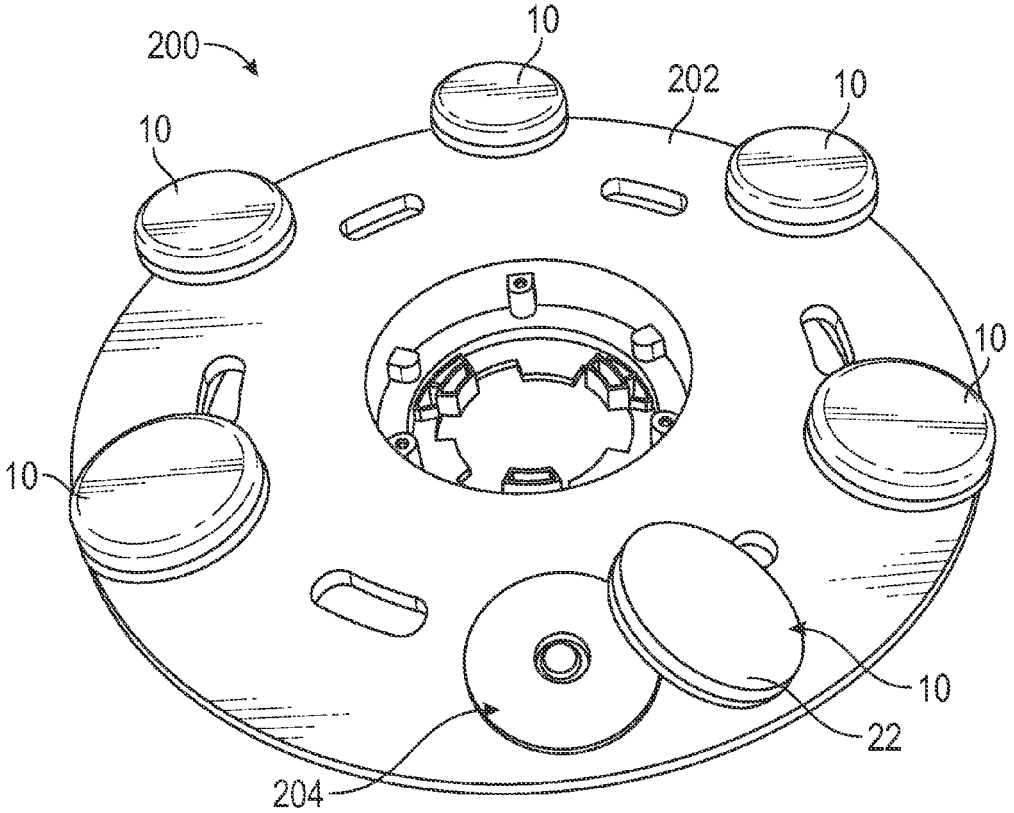
FIG. 4 is a top view showing several grouting pans affixed to a rotating head of a floor buffer or swing machine.

With particular reference to FIG. 4, the grouting pan 10 shown in FIGS. 1 and 2 are also well suited for use on a floor buffer or swing machine 200 having a rotary head 202. For example, multiple grouting pans 10 (six being shown) are affixed to a support 204 extending from the rotary head 202. The support 204 is configured with a fastener (e.g., a hook surface) that is complementary to the fastener (e.g., a loop surface) on the top surface 22 of the grouting pan. Additional grouting pans 10 may be affixed to the rotary head 202 as needed for a particular application. During operation of the finishing machine, the head 202 rotates the grouting pans 10 over the prepped surface for troweling the mortar onto the rough composite surface and forcing the mortar into the surface voids to form a grouted surface.

Figure 5:
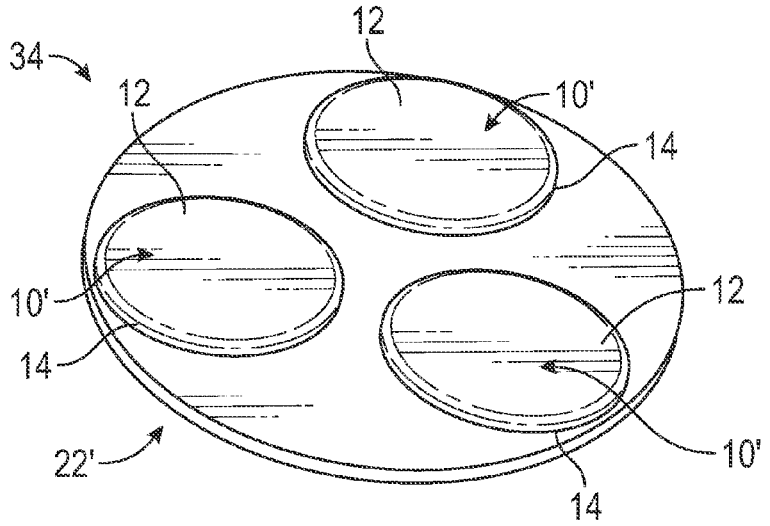
FIG. 5 is a perspective view of a grouting pan assembly have three grouting pans.
Figure 6:
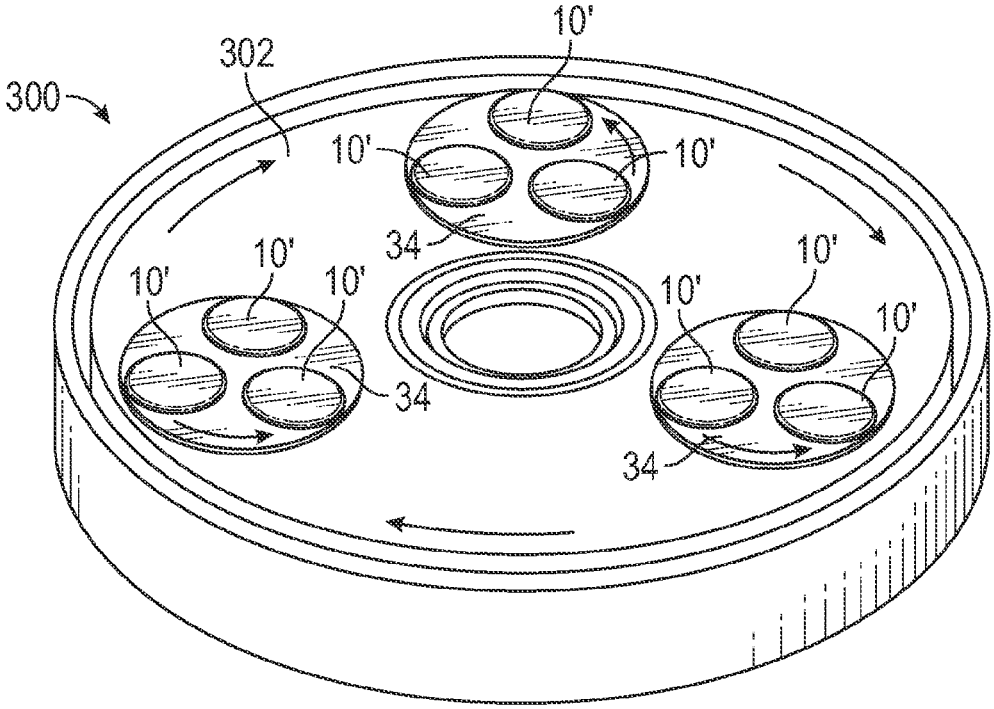
FIG. 6 is a top view showing several grouting pans affixed to a planetary head of a finishing machine.

With reference now to FIGS. 5 and 6, a grouting pan assembly 34 is illustrated as including three grouting pans 10' extending from a carrier 36. While three grouting pans 10' are illustrated herein, one skilled in the art will recognize that the number of grouting pans 10' is not limited to three and may include a plurality of grouting pans extending from the carrier 36. In this regard, the grouting pans 10' are structurally and functionally equivalent to but may be dimensionally different from the grouting pans 10 described above.

The carrier 36 provides sufficient surface area to accommodate the proscribed number of grouting pans. In this regards, the carrier 36 defines the top surface 22' configured to affix the grouting pan assembly 34 to a finishing machine 300 as best seen in FIG. 6. Furthermore, the carrier 36 may substitute for the intermediate layer 28 described above for resiliently supporting the grouting pans.

With particular reference to FIG. 6, the grouting pan assembly 34 shown in FIG. 5 is well suited for use on a finishing machine 300 having a rotary head 302 supporting a set of counter-rotating planets 304. For example, a grouting pan assembly 34 (three being shown) are affixed to the counter-rotating planet 304 which rotates in a direction opposite the rotary head 302. Additional grouting pan assemblies 34 may be affixed to counter-rotating planets 304 as needed for a particular application. During operation of the finishing machine, the head 302 rotate the grouting pan assemblies 10 in a clockwise direction as the planets 304 rotate each assembly 10 in a counterclockwise direction relative to the head 302 over the prepped surface for troweling the mortar onto the rough composite surface and forcing the mortar into the surface voids to form a grouted surface.

Figure 7:
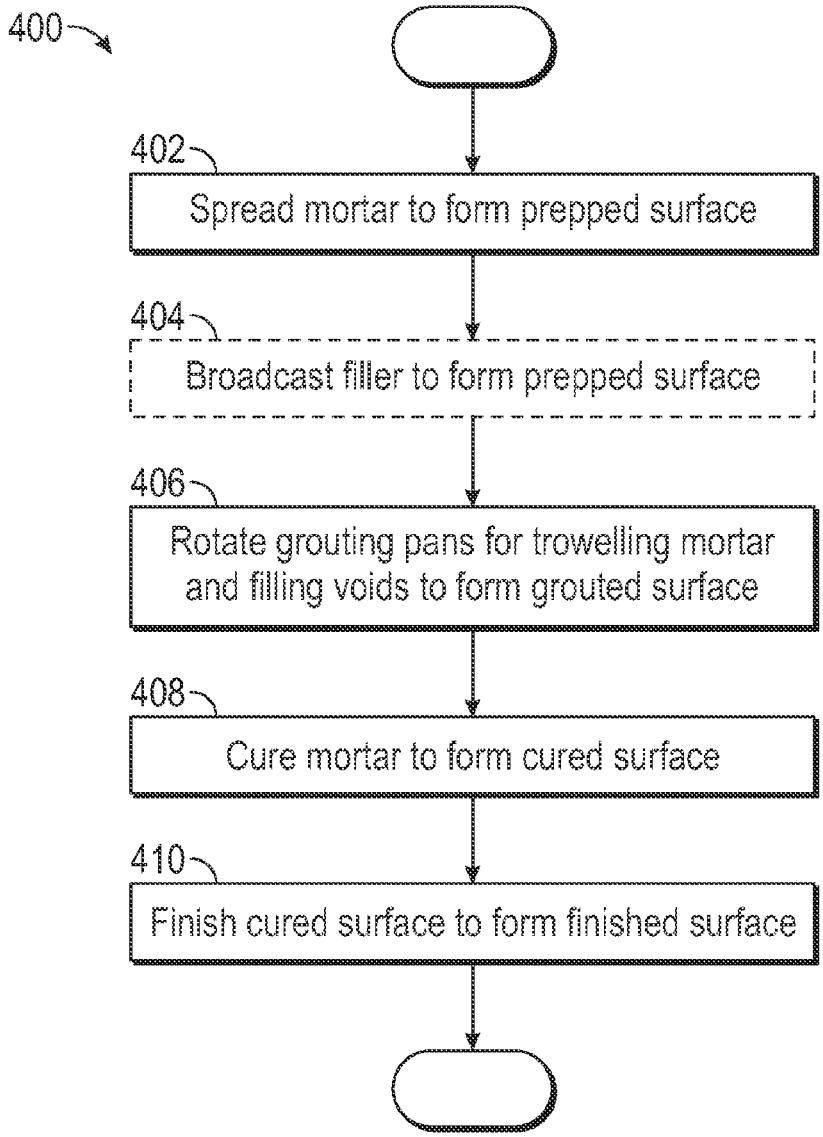
FIG. 7 is a flow-chart showing a method for finishing a composite floor using grouting pans on a finishing machine.

With reference now to FIG. 7, a method 400 for finishing a composite surface will now be described. While the method described herein has a specific application for grouting a terrazzo floor, the process has broader utility for finishing or re-finishing any composite surface including but not limited to epoxy, terrazzo, or cementitious surface with or without decorative aggregates. Initially, it is understood that a rough composite surface has been prepared in accordance the conventional method described in the background above with the following exception. The method described hereafter, and in particular the method for grouting the rough composite surface enables the use of a finer grit during the rough cut process than the very course or course grit used in conventional finishing. In particular, the rough composite surface may be finished to a 150-grit or 200-grit surface prior to grouting.

The method 400 for finishing a composite surface include spreading a mortar over the rough composite surface having surface voids to form a prepped surface as shown at block 402. Optionally, a filler may be broadcast on top of the mortar when forming the prepped surface as shown at block 404. The filler may be a very fine powder of pulverized stone (e.g., marble, lime stone, granite and/or quartz), calcium carbonate or cement. Grouting pans are rotated over the prepped surface such that the curved sidewalls trowel the mortar onto the rough composite surface and the bottom surface 12 which is in contact with the prepped floor forces the mortar into the surface voids such that a grouted surface is formed at block 406. The mortar on the grouted surface is allowed to cure such that a cured surface is formed at block 408. Then, the cured surface is ground to remove excess grout and finished using to a fine grit finish on the order of 200-grit or higher, then sealed and polished such that a finished surface is formed at block 410. The grouting pans 10 described herein are particularly well suited for use on a rotating head 102, 202, 302 of a finishing machine 100, 200, 300 when practicing the method 400 described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A grouting pan assembly for finishing a composite surface comprising:

a plurality of grouting pans;

a rotatable member configured to affix the grouting pans to a finishing machine; and each of the plurality of grouting pans including a bottom surface and a curved sidewall surrounding the bottom surface;

wherein the curved side wall includes an angled portion and a rounded edge portion formed between the bottom surface and the angled portion such that an obtuse included angle is formed therebetween.

2. The grouting pan assembly of claim 1 wherein the included angle is in the range of 110°-135° for each of the grouting pans.

3. The grouting pan assembly of claim 1 wherein the rounded edge has a radius of at least 4 mm for each of the grouting pans.

4. The grouting pan assembly of claim 1 wherein each grouting pan further comprising a generally circular inner body supporting a thin-walled outer shell.

5. The grouting pan assembly of claim 1 wherein each grouting pan further comprising an intermediate layer resiliently disposed between the inner body and the rotatable member.

6. The grouting pan assembly of claim 1, wherein each of the grouting pans includes a floor-contacting metallic shell including the bottom surface.

7. The grouting pan assembly of claim 1, wherein the bottom surface of each of the grouting pans has a circular periphery.

8. The grouting pan assembly of claim 1, further comprising:

a rotary head coupled to the machine;

at least three of the grouting pans being attached to the rotatable member which is a carrier;

the carrier being attached to the rotary head; and the carrier operably rotating in a different direction than the head.

9. The grouting pan assembly of claim 1, further comprising grout pushed into voids in a surface of a cured or dried composite or cement floor, by rotation of the grouting pans.

10. The grouting pan assembly of claim 1, further comprising a hook and loop fastening assembly attaching each of the grouting pans to the rotatable member.

11. The grouting pan assembly of claim 1, wherein an outer diameter of the bottom is smaller than an outer diameter of the sidewall of each of the grouting pans.

12. The grouting pan assembly of claim 1, wherein each of the grouting pans further comprises a compliant intermediate layer located between the bottom, which is metallic, and the rotatable member.

13. A grouting pan assembly comprising:

(a) an aggregate floor-finishing machine including a moveable member;

(b) a grouting-pan coupled to the member, the grouting-pan comprising:

(i) a floor-contacting metallic bottom having a circular periphery;

(ii) a side wall having a circular periphery; and (iii) a compliant intermediate layer located between the bottom and the member.

14. The grouting pan assembly of claim 13, further comprising a head to which the member is coupled, the member being a carrier to which the grouting-pan is attached, the head and the carrier rotating in opposite directions.

15. The grouting pan assembly of claim 14, further comprising at least a second rotatable carrier coupled to the head, and at least a second grouting-pan attached to the second carrier.

16. The grouting pan assembly of claim 15, further comprising:

a third rotatable carrier coupled to the head;

at least three of the grouting-pans being attached to each of the carriers; and the carrier and head rotating in a planetary manner.

17. The grouting pan assembly of claim 13, wherein the grouting-pan trowels mortar onto a cured or dried surface of a floor within the grouting-pan forcing the mortar into surface voids of the floor.

18. The grouting pan assembly of claim 17, wherein the floor includes marble chips, which is rough cut ground before the mortar is applied by the grouting-pan.

19. The grouting pan assembly of claim 17, wherein the floor includes an aggregate in a polymer-based material, which is rough cut ground before the mortar is applied by the grouting-pan.

20. The grouting pan assembly of claim 13, wherein a diameter of the periphery of the bottom is less than a diameter of the periphery of the side wall.

21. The grouting pan assembly of claim 13, further comprising a retainer, including a peripherally projecting rim, coupling the grouting-pan to the member.

22. The grouting pan assembly of claim 13, wherein the member is a rotatable head including multiple elongated legs projecting from a rotational axis, and the grouting-pan is located adjacent a distal end of one of the legs, further comprising an additional grouting-pan located adjacent a distal end of another of the legs.

23. The grouting pan assembly of claim 13, wherein the grouting-pan is stainless steel.

24. The grouting pan assembly of claim 13, wherein the floor-finishing machine is a floor buffer with the grouting-pan retrofit to the member which is a rotary head thereof.

25. The grouting pan assembly of claim 13, wherein the floor-finishing machine is a floor grinding machine with the grouting-pan retrofit to the member which is a rotary head thereof.

26. A grouting pan assembly comprising:

(a) a floor-finishing machine;

(b) multiple grouting-pans rotatably coupled to the machine, each of the grouting pans comprising:

(i) a floor-contacting bottom having a circular periphery;

(ii) a side wall;

(iii) a hook and loop fastener; and (c) grout troweled to fill floor-voids by rotation of the grouting-pans.

27. The grouting pan assembly of claim 26, further comprising a rotating head coupled to the machine and the grouting-pans being attached to the head.

28. The grouting pan assembly of claim 27, further comprising a second rotating head coupled to the machine and another set of the grouting pans being attached to the second head, the heads rotating in opposite directions.

29. The grouting pan assembly of claim 27, further comprising multiple rotatable carriers attaching the grouting-pans to the head, the carriers and head rotating in a planetary manner.

30. The grouting pan assembly of claim 26, further comprising a resilient layer located between the bottom of each of the grouting-pans and the fastener.

31. The grouting pan assembly of claim 26, wherein the grouting-pan is stainless steel.

32. The grouting pan assembly of claim 26, wherein the machine is a floor buffer with the grouting-pans retrofit thereto.

33. The grouting pan assembly of claim 26, wherein the machine is a floor grinding machine with the grouting-pans retrofit thereto.

34. The grouting pan assembly of claim 26, further comprising a floor including marble chips, the floor being rough cut ground before the grout is applied by the grouting-pans.

35. The grouting pan assembly of claim 26, further comprising a floor including an aggregate in a polymer-based material, the material being rough cut ground before the grout is applied by the grouting-pans.

* * * * *